United States Patent [19]

Sanderson

[11] Patent Number: 4,545,784

[45] Date of Patent: Oct. 8, 1985

[54] PARTICULATE SODIUM PERBORATE MONOHYDRATE CONTAINING ADSORBED ACTIVATOR

[75] Inventor: William R. Sanderson, Warrington, England

[73] Assignee: Interox Chemicals Limited, London, England

[21] Appl. No.: 598,197

[22] Filed: Apr. 9, 1984

[30] Foreign Application Priority Data

Apr. 14, 1983 [GB] United Kingdom ..... 8310080

[51] Int. Cl.[4] ..... C11D 3/39; C11D 7/54

[52] U.S. Cl. ..... 8/107; 8/101; 252/95; 252/99

[58] Field of Search ..... 8/107; 252/95, 99

[56] References Cited

U.S. PATENT DOCUMENTS

| | | | |
|---|---|---|---|
| 3,833,506 | 9/1974 | Fries et al. | 252/99 |
| 4,009,113 | 2/1977 | Green et al. | 252/95 |
| 4,207,199 | 6/1980 | Perner et al. | 252/95 |
| 4,372,868 | 2/1983 | Saran et al. | 252/102 |
| 4,457,858 | 7/1984 | Saran et al. | 252/182 |

FOREIGN PATENT DOCUMENTS

| | | |
|---|---|---|
| 7566 | 2/1980 | European Pat. Off. . |
| 3003351 | 8/1981 | Fed. Rep. of Germany . |

*Primary Examiner*—A. Lionel Clingman

*Attorney, Agent, or Firm*—Larson and Taylor

[57] ABSTRACT

It would be desirable to improve upon the washing or disinfection capability of hydrogen peroxide-generating compositions at ambient to low operating conditions. The instant invention provides bleach compositions in which an activator is adsorbed into sodium perborate monohydrate, often in an amount of 20–40% w/w thereof. The invention permits liquid and consequently often low molecular weight activators to be readily employed in solid formulations. Preferred activators are selected from enol esters or gem-diesters, including vinyl benzoate, ethylidene benzoate acetate and divinyl adipate. The invention can also render N-acyl activators such as TAED more storage-stable.

32 Claims, No Drawings

PARTICULATE SODIUM PERBORATE MONOHYDRATE CONTAINING ADSORBED ACTIVATOR

The present invention relates to bleach compositions, and in particular to particulate compositions suitable for generating peroxy acids in aqueous solution.

Traditionally, heavy duty washing compositions have been employed in conjunction with, or have themselves contained, one or more oxidising bleaching agents. In Europe and to a lesser extent in America, the bleaching agents have been inorganic persalts, of which the two major solid persalts used have been sodium perborate tetrahydrate and sodium percarbonate. The persalts are very effective at high wash temperatures, but the continuing increase in the cost of energy has led to a trend towards lower washing temperatures, typically in the regions of ambient to 50° C., at which the persalts are comparatively less effective. Accordingly, considerable efforts have been devoted by many organisations to provide a way of generating an active bleaching species especially peroxyacids/anions at low temperatures and there have been many proposals to incorporate activating compounds, usually referred to as activators or bleach activators in the washing or bleach additive compositions. Various of these activators are liquid at or near ambient temperature, with the result that they cannot be incorporated in solid particulate compositions unless they themselves have been converted to the solid state. There are various methods that are theoretically possible including the production of sachets and adsorption onto or into a solid substrate. In the second method, the activator can be adsorbed onto an inert three dimensionally cross-linked macromolecular water-insoluble inorganic compound, according to German Patent Specifications Nos. 2733849A and 3003351A the latter of which gives a list of silicon-oxygen-aluminium compounds as adsorbents for one type of activator. Whilst it is obvious that adsorbent materials may adsorb liquid activators, the value of such an operation depends upon the extent to which the activator can be released from the adsorbent in use with subsequent generation of the active bleaching species. In practice, comparative tests with various activators described herein showed that although various of the aforementioned adsorbents effectively adsorbed the activators, as demonstrated by the resulting mixture being a free-flowing particulate material, in washing tests using the adsorbed material with a persalt the resulting bleaching effect, as measured by the proportion of stain removed from samples was only little better than that of the persalt by itself and markedly worse than the use of activator added separately from the persalt, all tests being otherwise carried out under identical conditions. It was deduced that the release of the activator from the adsorbents was being hindered or that possibly the activator suffered a preferential non-activating reaction during or before release. Consequently, the German patent specifications do not provide a clear teaching on how to readily incorporate liquid activators in particulate compositions.

According to the presenat invention there is provided particulate sodium perborate monohydrate having adsorbed therein one or more activators.

Advantageously, it has been found that the activator and the persalt react together in aqueous solutions to generate the peracid, without any significant impairment of the effective of the persalt/activator system being detectable in comparison with the two components being added separately.

The classes of activator which can readily be employed in compositions of the present invention include N-acyl and O-acyl compounds. In such compounds, the acyl group (Ac)usually has the formula $R^a$—CO— in which $R^a$ represents a hydrogen group or an aliphatic $C_1$ to $C_{10}$ group or an aromatic group, optionally substituted by an alkyl or carboxylic acid group, or has the formula —CO—$R^b$—CO— in which $R^b$ represents an aliphatic $C_2$ to $C_{10}$ diradical or an aromatic or cyclohexenyl diradical, optionally substituted by one or more alkyl or carboxylic acid groups. For hydrophilic stain bleaching Ra is often selected from alkyl $C_1$ to $C_4$ and for hydrophilic stain bleaching or improving fabric dinginess $R^a$ can be selected from alkyls of chain length $C_5$–$C_9$, optionally $C_1$–$C_2$ branched. A mixture of activators containing the differing chain length acyl groups can be employed so as to tackle both wash problems simultaneously. Examples of suitable acyl groups include formyl, acetyl, propionyl, hexanoyl, octanoyl benzoyl, phthaloyl, cyclohexanecarbonyl, succinoyl, glutaroyl, adipoyl, azelaoyl sebacoyl,and dodecandioyl radicals.

In some especially desirable embodiments, the O-acyl compound is an enol ester or a gem diester which has the following general formula (I):

$$(E)_m—R^c—(G)_n \quad (I)$$

in which E represents a moiety of formula (II)

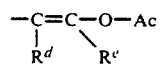

(II)

and G represents a moiety of formula (III)

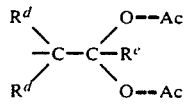

(III)

and both m and n are 0, 1 or 2 provided that n+m=1 or 2, in which formulae $R^d$ is selected from hydrogen or $C_1$–$C_5$ alkyl or $C_2$–$C_4$ alkenyl or a phenyl radical, and $R^e$ is selected from hydrogen or $C_{1-5}$ alkyl radical or a phenyl radical, or combines with $R^c$ or $R^d$ and the olefin group in formula (II) to firm a carbocylic radical, $R^c$ is selected from hydrogen or $C_1$–$C_5$ alkyl or $C_2$–$C_4$ alkenyl or phenyl radicals when n+m=1 and is selected from a carbon-carbon bond or represents a branched or unbranched aliphatic or cycloaliphatic or aromatic hydrocarbon diradicals, usually up to 10 linear carbon atoms when n+m=2 and Ac represents an acyl group which has the formula $R^a$—CO— in which $R^a$ represents a hydrogen group or an aliphatic $C_1$ to $C_9$ group or an aromatic group, optionally substituted by an alkyl or carboxylic acid group, or has the formula —CO—$R^b$—CO— in which $R^b$ represents an aliphatic $C_2$ to $C_{10}$ diradical or an aromatic or cyclohexenyl diradical, optionally substituted by one or more alkyl or carboxylic acid groups.

In many desirable embodiments $R^e$ represents hydrogen or methyl or ethyl, and in the same or other embodiments $R^d$ is often selected from hydrogen, methyl, ethyl or the various propyl and butyl groups. Preferred enol esters include vinyl, isopropenyl, isobutenyl, n-butenyl, and cyclohexenyl esters or alternatively diethenyl esters spaced by phenylene or $C_2$–$C_4$ polymethylene radicals. High favoured enol ester activators include vinyl acetate., isopropenyl acetate, divinyl adipate, divinyl azelate, divinyl trimethyladipate vinyl benzoate, isopropenyl benzoate, di-vinyl phthalate or cyclohexenyl acetate or 1,4-diacetoxybuta-1,3-diene and 1,5-diacetoxypenta-1,4-diene. Alternatively the corresponding propionates may be employed instead of the acetates.

Highly favoured gem-diester activators include ethylidene or isopropylidene diesters and tetraesters of $C_4$–$C_{10}$ unbranched polymethylene diradicals and the corresponding methyl or ethyl substituted diradicals. Especially suitable representative members of this type of activator are ethylidene diacetate, ethylidene dibenzoate, 1,1,4,4-tetraacetoxybutane and 1,1,5,5-tetraacetoxypentane. It will be understood that the two gem diester groups need not be the same and for example one can be aliphatic and the other aromatic, such as acetate or propionate for one and benzoate or alkyl substituted benzoate or one short chain acetyl ($C_2$–$C_4$) for the other, and the other a longer chain acetyl ($C_6$–$C_9$). A most highly valued example of such a mixed ester compound is ethylidene benzoate acetate and other examples include isopropylidene benzoate acetate, bis (ethylidene benzoate) adipate, and bis (ethylidene acetate) adipate or azelate or trimethyladipate, and ethylidene acetate heptanoate or hexanoate or octanoate or 2-ethyl-hexanoate or 3,5,5-trimethyl hexanoate or cyclohexane carboxylate.

It will be recognized that the activator can comprise an enol ester at one end of the molecule and a gem-diester at the other end and such mixed compounds can be formed to a greater or leser extent during especially the formation of tetraester compounds. Desirable examples of such activators include 1,1,4-triacetoxybut-3-ene, 1,1,5-triacetoxypent-4-ene and vinyl (ethylidene acetate) adipate.

In various other desirable embodiments of the present invention, the activator is an N-acyl group, the acyl groups being selected from the same groups as for the O-acyl compounds. One especially desirable class of N-acyl compounds comprises N-acyl caprolactam. Once again, it is particularly suitable to select the N-acetyl compound but the various other specified acyl groups can be employed instead. Alternatively, the N-acyl group can comprise a low molecular weight imide or amide group.

It is highly convenient to employ activators which are either liquid at ambient temperature or melt at only mildly elevated temperatures, so that the activator can be introduced to the sodium perborate monohydrate in liquid form, but at a temperature sufficiently low that decomposition of the sodium perborate monohydrate is not induced to any significant extent. It will be recognised that many of the compounds described hereinbefore fall into such a particularly preferred category. These include vinyl acetate and vinyl benzoate, N-acetyl caprolactam, butylidene diacetate, di-vinyl adipate and ethylidene diacetate and acetate benzoate.

Where the melting point of the activator is too high for it to be readily incorporated in molten form with the sodium perborate monohydrate, the activator can be dissolved in a suitable organic solvent such as a low molecular weight ester or ether hydrocarbon or chlorinated hydrocarbon and the solution incorporated in the persalt, possibly with subsequent recovery of at least part of the solvent therefrom. Such solutions, if used, are preferably at or near saturation, and the cycle can be repeated until the persalt has taken-up the desired amount of activator. This technique is particularly useful for tetraacetyl ethylene or methylene diamine (TAED or TAMD) or tetra acetyl glycol urils (TAGU). Other solid activators for which it is applicable include glucose pentaacetate. It is preferable to select an organic solvent having a low boiling point, e.g. of below 70° C., so that it can readily evaporate off without the persalt being heated excessively.

It has been found that in practice the sodium perborate monohydrate can adsorb up to approximately 30–40% of its weight of activator. As the amount of activator added is increased beyond that range, there is a growing tendency for the product to become sticky or to cake. In the interests of obtaining a free flowing product, therefore, whilst maximising the activator content of the composition, the weight ratio of persalt to activator is preferably selected in the range from 3:1 to 4:1, although, of course, weight ratios of 4:1 to 6:1 still contain a lot of activator and ratios of up to 10:1 or even higher can readily be contemplated.

The sodium perborate monohydrate for use in the instant invention can conveniently be made by the well-known techniques of dehydrating a higher-hydrated sodium perborate, such as the tetrahydrate, such as British, Pat. Nos. 1449511A or 1520127A by Peroxid-Chemie GmbH. Selection of the desired grade of monohydrate will take into account both the capacity and friability of the monohydrate, since both tend to increase in line with the surface area of the monohydrate. It is preferable for the monohydrate to be as dry as possible in use, or even slightly overdried.

It will be recognised that by adsorbing the activator upon the persalt, the problem of segregation of persalt from activator during handling, transportation and storage of the composition is in substance eliminated. Accordingly, the instant composition prevents variations in the performance of the composition arising from possible changes in the weight ratio of persalt to activator in separate parts of the composition containing them both. This advantage applies not only as between persalt and activator, but also as between activator and activator where a mixture of two or more activators is used. Secondly, dilution of the active composition with a diluent is avoided and thirdly there is a further benefit namely that the substrate is water soluble and thus does not introduce insoluble particles that would require extra anti-redeposition agents to prevent them from soiling any fabrics contacted with the washing solution. Surprisingly, it has also been found that the resultant absorbed activator/persalt composition can be more storage stable with respect to activators that are difficult to store in washing composition, an N-acyl representative of which being TAED. Avox and activator losses had been thought to be caused by interaction between the persalt and the activator so that conventional wisdom has advocated their separation by interposing a physical barrier. Such a technique is the exact opposite of the instant invention in which the persalt and activator are brought into completely intimate contact with each other.

The persalt composition described herein can be employed by itself to generate an aqueous solution of a peracid which could be employed not only for bleaching but also for disinfection of, for example, aqueous media or hard surfaces taking advantage of the biocidal properties of the peracetic acid or other organic peracid generated. Alternatively, it can be employed as a bleach additive for subsequent use with washing compositions, or as a component in its own right in washing compositions. If desired, the persalt/activator composition can subsequently be mixed, for example by blending particles, or by granulation, aggregation or agglomeration with one or more of the other components of washing compositions, such other components comprising, for example, solid detergent builders, processing aids, or diluents. Thus, for example, the persalt/activator particles can be brought into mixture with up to 20 parts of their weight of one or more of such other components, further particulars of which are given hereafter.

In addition to such other components of the washing composition or bleaching composition, persalt/activator compositions can further comprise one or more coatings for the persalt particles, thereby to minimise the interaction of those particles with other components or with a humid atmosphere. Such coatings usually comprise water soluble materials, or materials that are dispersible under the conditions of temperature and alkalinity prevalent during use of the compositions, or that can be abraded so as to expose the surface of the persalt/activator during use.

It will be fully understood by the skilled worker in the fields of persalt manufacture and manufacture of compositions containing persalts, especially alkaline compositions, that there are very many inorganic and organic materials and combinations of them which can be employed so as to at least partially protect the persalt core from its environment and of course there are variations in the efficiency of such protection as between the various materials and variation dependent upon the amount of the coating material used, and the depth of such coatings and the evenness of distribution of the coating material. It is advantageous for the coating agent to remain solid during storage of the persalt/activator compositions, thereby to minimise any likelihood of the composition caking. For use in most countries therefore, it is desirable to select coating agents that remain solid at 35° C.

The organic coating agents can be selected from both soluble and insoluble agents. Within the class of water-soluble agents, many of them comprise as the water solubilising moiety, a polyalkyleneglycol, especially polyethylene glycol or a polymer substituted regularly by hydroxyl and/or carboxylic acid groups, such as polyacrylic acid and/or includes within the polymer chain solubilising linkages such as in polyesters. Alternatively, all or part of the coating can comprise derivatives of one of the aforementioned polymers in which they are substituted generally by only one but optionally by two hydrophobic groups producing fatty acid alkanolamides, fatty alcohol polyglycol ethers, alkaryl polyglycol ethers, and fatty acid ester and amide derivitives thereof. As a further alternative, the water soluble coating agent can be a fatty acid ester or amide, derivitive of polyhydroxy monomers including glycerol, sorbitol and the like, including other hydrogenated sugars. Furthermore, various other soluble natural products can be employed, and in particular products derived by hydrolysis of cellulose and various cellulose derivitives, including CMC and also the water soluble products obtained by hydrolysis of proteins and starches, including dextrin, the various gelatins and the starches.

It is possible also to employ water-insoluble organic materials such as waxes, fatty acids, aromatic acids,and water insoluble ester or amide derivatives thereof and fatty alcohols, the product normally having melting points in the range of 40°-100° C. Examples of such water-insoluble coating agents include polyethylene waxes from distilling crude oil and lauric or stearic acid or mixtures like coconut or tallow fatty acids, or the alkaline metal salt of such acids can readily be used. Insoluble esters include n-butyl and di-n-butyl phthalate. In order to improve the dispersion of such water insoluble coating agents in use, the coating can incorporate a small proportion of a dispersant agent which for convenience is often an anionic or non ionic surfactant blended with the coating agent.

A further class of highly valued organic agents comprises aliphatic esters of silicates and titanates, of which one especial member is tetraethyl silicate.

Such coating agents afore-mentioned can readily be employed by a mixture in melt form, or as a solution in a capable solvent, preferably one selected having a comparatively low boiling point so as to facilitate its subsequent separation from the coated particles. The conventional apparatus such as fluidised beds, rotating drums, and rotating pans can be used.

In an alternative or complementary method, at least some of the organic agent can be premixed with the activator, or otherwise incorporated within the perborate monohydrate simultaneously with the activator. This is particularly advantageous for the silicate/titanate esters, which can be so employed, often in an amount up to 20% and typically from 5 to 15% by weight based on the activator.

Alternatively, or additionally, either before and/or after the organic coating, the persalt/activator particles can be coated with an inorganic coating. Amongst the inorganic coating agents one important class includes alkali and alkaline earth metal salts with halide-free strong acids and in particular salts of sulphuric and the various phosphoric acids. The salts are preferably either sodium and/or magnesium salts. It will be understood that several of these salts such as sodium sulphate or magnesium sulphate can adopt various degrees of hydration. For the avoidance of doubt, each of such salts can be employed in its anhydrous form whereby it serves to take up moisture from the environment of the persalt during storage, and thereby enhance product storage stability or in partially or completely hydrated form whereby the compound can act as a exotherm control agent. Other salts that can be used include alkali/alkaline earth metal carbonates or bicarbonates or borates or aluminosilicates or clays, the latter two of which are water-insoluble, aluminium sulphate and the solid boric acids and silicic acids and their salts.

It will be recognised that the majority of the inorganic coating agents are water-soluble and are readily applied to the persalt/activator particles in the form of highly ground particles which can be granulated around the persalt particles by conventional granulation/coating techniques. Naturally, use of a small amount of a granulating aid can be employed, if needed, including the water soluble organic compounds disclosed hereinbefore as soluble coating agents.

The amount of coating agent employed is generally selected in the range of 1-35% by weight of the persalt-/activator particles. However, it will be recognised that where the coating agent itself can perform some other function in the subsequent use of the composition, and where it is water soluble, larger amounts can be readily tolerated. Such as, for example where it acts as a detergent builder or buffers the solution to near the peracid $pK_a$, or has surfactant properties.

It will be further recognised that where the aforementioned coating agents are solid at normal storage temperatures, such compounds need not be employed solely as coating agents but may additionally or alternatively be employed as diluents, often in particulate form that are admixed with the persalt particles, for example to form a buffered bleach additive. In such circumstances, such diluent materials can represent from 20 to 300%, often 50 to 200% by weight of the persalt, and possibly even more in aggregate.

As referred to hereinbefore, the persalt/activator material can be employed in conjunction with a washing composition. Such a washing composition would normally contain from 5–95% and often from 5–40% of a surface active agent or combination of agents selected from anionic, nonionic, cationic and ampholytic, and zwitterionic surfactants and normally from 1–90% of one or more detergent builders, frequently from 5–70% and often up to 50% by weight of diluents or processing additives, and finally up to 20% by weight of auxiliary agents such as soil anti-redeposition agents, dye-transfer inhibitors, optical brightening agents, stabilisers for peroxygen compounds, pH control agents, corrosion inhibitors, bactericides, dyes, perfumes, foam enhancers, foam inhibitors, adsorbents and abrasives. Such compositions can also include one or more enzymes.

The surfactants can be synthetic or soaps. Suitable examples are described in Chapter 2 of "Synthetic Detergents" by A. Davidsohn and B. N. Milwidsky, 5th Edition published by Leonard Hill, London in 1972. Amongst anionic surfactants described on pages 15–23 therein, sulphonates and sulphates are of especial practical importance. The sulphonates include alkaryl sulphonates and particularly $C_9$–$C_{15}$ alkyl benzene sulphonates. Others include olefin sulphonates. Amongst desirable sulphate surfactants there are alcohol sulphates and sulphated monoionic surfactants and alkyl ether sulphates. Other anionic surfactants include phosphated ethylene oxide-based nonionic surfactants.

Within the class of nonionic surfactants, ethylene oxide and possibly propylene oxide condensation products and derivitives thereof are of special importance, and in particular the derivatives with fatty alcohols, alkyl-phenols, or the corresponding aliphatic esters or amides. Semi-polar detergents can also be used, including amine oxides, phosphine oxides and water-soluble sulphoxides.

The non ionic and anionic surfactants are often employed in the same composition in a weight ratio of 2:1 to 1:10.

Useful cationic surfactants herein are often quaternary ammonium salts such as tetra alkyl ammonium halides or quaternary pyridinium salts.

The useful amphoteric surfactants include derivatives of aliphatic quaternary ammonium, sulphonium and phosphonium compounds containing a hydrophobic moiety and an anionic water solubilising group, often selected from carboxylic acid, sulphate and sulphonate groups.

The detergent builders employable herein can be either inorganic or organic. Inorganic builders include pyrophosphates, tripolyphosphates and higher polymeric phosphates sometimes referred to as hexametaphosphates. Other builders include aluminosilicates, such as zeolites A or X or Y and borates, carbonates and silicates. Althouqh any alkali metal salt can be used, they are preferably in the sodium salt form. Acid phosphate salts and boric acids are examples of builders providing a lower pH.

Useful organic builders herein include hydroxycarboxylic acids, polycarboxylic acids, aminocarboxylic acids and polyphosphonic acids, often employed in the alkali metal, especially sodium salt form but optionally at least partially in acid form thereby to provide a lower wash or disinfectant pH. Representatives of the classes of organic builders include citric acid, 1,1,3,3-propane tetracarboxylic acid or polyacrylic acid, or oxydiacetic acid or oxydisuccinic acid or furan tetracarboxylic acid. NTA is of special importance and others include EDTA and DTPA. Phosphonic acid chelating builders include especially hydroxyalkyl- 1,1 - diphosphonic acid, (HEDP) ethylenediaminotetramethylene tetraphosphonic acid (EDTMP) and diethylenetriaminopentamethylene pentaphosphonic acid (DTPMP). It will also be recognised that a small amount, e.g. 1–5% w/w of the composition of such organic builders can usefully be added, particularly the said phosphonates and complexing carboxylates to assist the stability of the composition in storage or in use, and/or to sequester metallic ion impurities, even when the main builder(s) is or (are) inorganic.

The builder in conjunction with the surfactant, often produces a washing solution that has a pH of at least pH7 and often pH8—10.5.

Especially where the persalt/activator is employed as a bleach additive, possibly mixed with a detergent builder and/or a small amount of surfactant, it can be more convenient to employ it as a granulate, extrudate, or as a tablet or enclose it within a water-soluble or water-dispersible sachet or in a porous container through which a solution of percompounds can leach out into the wash or disinfection liquor. Where the composition has been compacted such as in the formation of tablets, it is preferable to incorporate a disintegrating aid, conventionally micro-fine starch or microcrystalline cellulose in a small amount, such as 2% w/w of the tablet.

Washing, disinfecting or bleaching processes according to the present invention can be carried out at any temperature up to the boiling point of aqueous solution of the persalt/activator, but preferably from ambient to 60° C. In general it is desirable to employ sufficient of the persalt/activator, to yield at least one part of available oxygen (avox) per million parts by weight of solution and preferably at least five parts per million. As a guide, eight to nine parts by weight of persalt/activator yields one part by weight avox when the weight ratio of persalt/activator is 100:30. For household washing solutions, obtained by dissolution of a detergent composition either containing or into which is introduced the persalt/activator, the concentration of avox is frequently from 5–100 parts Avox per million parts of solution by weight, but more concentrated solutions can be employed if desired, such as up to 200 ppm avox especially in commercial laundry operations.

The period of contact between an aqueous washing solution containing the persalt/activator with the fabric, clothes or other articles to be washed is often at least 5 minutes and generally each wash is between 10 minutes and an hour However for cold soaking or steeping, longer periods such as steeping overnight can be employed also. The aforementioned solutions can be employed also to wash and disinfect hard surfaces of which typical examples are metal, plastic, wood, ceramic, glass or paint-coated surfaces. The persalt/activator composition can be employed in the rinse stages of a machine wash cycle, especially in the first rinse. As an alternative, a slurry or paste of the composition containing the persalt/activator and having a much higher avox content whereby, such as from 200–500ppm avox may be employed instead. Furthermore, the solutions obtained by dissolution of the compositions hereinbefore described to yield the appropriate concentration of avox can be used to bleach textile fabrics, wood or pulp under the conditions and employing the equipment used for bleaching such articles with alkaline hydrogen peroxide.

Having described the invention in general terms specific embodiments will be described hereinafter more fully by way of example only and modifications thereto based upon the foregoing general disclosure can be made by the skilled worker whilst clearly remaining within the terms and spirit of the instant invention.

EXAMPLES

Preparation of the Persalt/Activator Compositions

In each Example and comparison, sodium perborate monohydrate (PBSI) in particulate firm or a particulate acid-activated calcium montmorillonite was mixed with 30% by weight of the specified activator in liquid form at an initial temperature of 20°–30° C. The activator was introduced in small portions onto the solid in a beaker and stirred until the mix was free flowing. This procedure was repeated until all the activator had been adsorbed by the persalt or the montmorillonite, about 5–15 minutes and the resulting product was a mobile particulate material in each case. The activator in Examples 1 to 4 and their corresponding comparisons were as follows:

1. Vinyl Acetate; (VA)
2. N-Acetyl Caprolactam; (NAC)
3. n-Butylidene diacetate; (NBD)
4 Divinyl adipate. (DVAD)

Washing Effectiveness of the Compositions

The effectiveness of each of the Example and comparison compositions at bleaching stains was tested by contacting different samples of the same representative red wine-stained cloth with an aqueous solution of a persalt-free detergent composition, available in the U.S.A. from Procter and Gamble under the trademark TIDE (lower phosphorus content, 1.5 gpl concentration). Each washing solution contained additionally 0.5 gpl sodium perborate monohydrate, 0.15 gpl activator and as required in the comparisons 0.5 gpl adsorbent material for the activator. The solution water contained 250 ppm hardness having a weight ratio of calcium: magnesium of 3:1. The washing trials herein were carried out at a typical hand-hot washing temperature of 40° C. or a typical cool wash temperature of 25° C. in a laboratory scale washing machine available from U.S. Testing Corporation under the name TERGOTOMETER. The samples were removed after either 10 minutes or 20 minutes washing and then rinsed, dried and their reflectance determined. In addition, further comparison runs were carried out employing the same weight of sodium perborate monohydrate but without activator in the detergent solution.

The reflectance of each red-wine stained sample was measured before and after washing with an Instrumental Colour Systems MICROMATCH reflectance spectrophotometer equipped with a xenon lamp fitted with a D65 conversion filter to approximate to CIE artificial daylight, i.e. wavelengths below 390 nm being excluded. The percentage stain removal was calculated from the reflectance readings by the formula:

$$\% \text{ Stain Removal} = 100x(R_w - R_s)/(R_u - R_s)$$

in which $R_w$, $R_s$ and $R_u$ represent respectively the reflectance of the washed sample, the stained sample before washing and the sample before staining.

The results are summarised in Table 1 below.

In the Table, PBSI represents Sodium Perborate Monohydrate, VA - Vinyl Acetate, NAC - N-Acetyl Caprolactam, NBD - n-Butylidene Diacetate, and DVA - Divinyl Adipate.

TABLE 1

| BLEACH ADDITIVE | | | % STAIN REMOVAL at 40° C., pH9 | |
|---|---|---|---|---|
| | | | 10 min | 20 min |
| PBSI | | | 35 | 39 |
| PBSI, VA | added | separately | 51 | 56 |
| Example 1 | | $PBS_I$/VA | 50 | 55 |
| Comparison 1 | | earth/VA | 40 | 46 |
| PBSI, NAC | added | separately | 48 | 55 |
| Example 2 | | $PBS_I$/NAC | 47 | 54 |
| Comparison 2 | | earth/NAC | 42 | 46 |
| PBSI, NBD | added | separately | 42 | 52 |
| Example 3 | | $PBS_I$/NBD | 43 | 52 |
| Comparison 3 | | earth/NBD | 41 | 46 |
| PBSI, DVAD | added | separately | 48 | 52 |
| Example 4 | | $PBS_I$/DVAD | 49 | 54 |
| Comparison 4 | | earth/DVAD | 37 | 38 |

From the foregoing Table, it can be readily determined that the effectiveness of the stain removal employing the activator adsorbed on the sodium perborate monohydrate is substantially the same as when the sodium perborate monohydrate and the activator were introduced separately, whereas when the activator was introduced in adsorbed form upon the montmorillonite, there was a substantial and significant impairment of the stain removal, bringing it very close in many cases to the result obtainable in the absence of activator. These results, therefore, demonstrate that sodium perborate monohydrate is a substantially superior adsorbent for bleach activator than is the insoluble montmorillonite material hitherto proposed as adsorbent.

Further samples of PBSI/DVAD were prepared and tested in the same way, except that the bleach was added in such an amount to yield theoretically on 100% dissolution, the concentration of available oxygen (Avox) shown.

TABLE 2

| Sample | Avox ppm | pH | Temp °C. | % Stain Removal 10 mins | 20 mins |
|---|---|---|---|---|---|
| PBSI | 50 | 8 | 40 | 56 | 60 |
| PBSI/DVAD | 26 | 8 | 40 | 74 | 78 |
| PBSI/DVAD | 15 | 8 | 40 | 72 | 76 |
| $PBS_I$ | 50 | 8 | 25 | 42 | 46 |
| PBSI/DVAD | 26 | 8 | 25 | 62 | 69 |
| PBSI/DVAD | 15 | 8 | 25 | 61 | 67 |

Table 2 demonstrates clearly that peracid is being generated rapidly at both 25° and 40° C. at pH8.

Further trials were effected in which PBSI was compared with a zeolite that has been suggested for incorporation in detergent compositions as a builder namely X zeolite in sodium form (13X) selected on account of its comparatively large pore size. The activator was adsorbed onto the PBSI or zeolite in the same general manner as before, the tests were carried out as for Examples 1–4 and the comparisons and the results are summarised in Table 3.

TABLE 3

| Sample | % Stain Removal at 40° and pH9 | |
|---|---|---|
| | 10 mins | 20 mins |
| PSBI | 50 | 51 |
| PBSI, DVAD - added separately | 63 | 67 |
| Ex 5 - PBSI/DVAD | 65 | 69 |
| Comp 5 - 13X/DVAD | 58 | 62 |
| PBSI, NAC - added separately | 67 | 70 |
| Ex 6 - PBSI/NAC | 67 | 71 |
| Comp 6 - 13X/NAC | 56 | 64 |

From the results in Table 3, it can readily be seen that the washing was significantly worse when the activator was adsorbed onto zeolite 13X than when adsorbed onto PBSI, particularly in respect of the shorter washing period.

Further samples of absorbed activators were made using the method for Examples 1–4 and 8 parts by weight DVAD or VA or VB per 35 parts PBSI, and additionally in Example 5, the method was repeated using 8 parts by weight of ethylidene benzoate acetate (EBA) per 35 parts of PBSI. The bleaching performance of the compositions was then tested after blending at ambient temperature each of them with 20 parts adipic acid (acidic buffer) and 37 parts of anhydrous sodium sulphate, thereby forming for each a bleach additive composition containing DVAD, or EBA, or VA or VB, respectively called BAA, BAB, BAC and BAD. A further and comparative buffered composition containing 10.2 parts of solid tetraacetyl ethylene diamine (TAED, reference activator) 10 parts PBSI, 7 parts adipic acid and 72.8 parts by weight anhydrous sodium sulphate was also prepared by simply blending the components and this was called BAT.

Washing trials were carried out at 40° C. using a medium wash in a domestic top-loader automatic washing machine of 47 litre capacity from Maytag in the USA in conjunction with the abovementioned TIDE detergent compositions of 6% phosphorus content, at 1.5 g/l concentration in water of 250 ppm hardness (Ca:Mg weight ratio of 3:1). Sufficient bleach additive was introduced to yield 10, 20 or 30 ppm peracid Avox in solution theoretically generated from the activator and PBSI, shown in Table 4. The stain removal from prestained swatches of cotton or polycotton mixed with a domestic wash load of medium soil was measured in the manner and using the apparatus described hereinbefore. The results are summarised in Table 4. A −ve indicates net stain darkening.

TABLE 4

| Cloth and stain | % Stain Removal using bleach additives (at ppm peroxyacid Avox) | | | | | | | | | | | |
|---|---|---|---|---|---|---|---|---|---|---|---|---|
| | BAA | | | BAB | | BAC | | BAD | | BAT | | |
| | 10 | 20 | 30 | 10 | 20 | 10 | 20 | 10 | 20 | 10 | 20 | 30 |
| Cotton | | | | | | | | | | | | |
| Red | 55 | 64 | 67 | 61 | 67 | 51 | 60 | 63 | 67 | 49 | 54 | 61 |

TABLE 4-continued

| Cloth and stain | % Stain Removal using bleach additives (at ppm peroxyacid Avox) | | | | | | | | | | | |
|---|---|---|---|---|---|---|---|---|---|---|---|---|
| | BAA | | | BAB | | BAC | | BAD | | BAT | | |
| | 10 | 20 | 30 | 10 | 20 | 10 | 20 | 10 | 20 | 10 | 20 | 30 |
| Wine | | | | | | | | | | | | |
| Coffee | 52 | 60 | 61 | 55 | 63 | 53 | 57 | 57 | 64 | 51 | 52 | 56 |
| Bil-berry | 62 | 70 | 75 | 69 | 75 | 61 | 66 | 70 | 77 | 56 | 59 | 70 |
| Tea | 24 | 41 | 44 | 27 | 43 | 22 | 33 | 32 | 42 | 20 | 23 | 33 |
| Cocoa | 14 | 18 | 17 | 12 | 17 | 14 | 16 | 15 | 17 | 14 | 13 | 16 |
| EMPA 101 | 28 | 34 | 24 | 26 | 32 | 35 | 40 | 34 | 36 | 32 | 32 | 37 |
| Clay | 74 | 75 | 75 | 72 | 77 | 78 | 80 | 75 | 78 | 76 | 75 | 78 |
| Poly-cotton | | | | | | | | | | | | |
| Red | 10 | 27 | 28 | 22 | 34 | 9 | 18 | 29 | 37 | 10 | 13 | 21 |
| Wine | | | | | | | | | | | | |
| Coffee | 42 | 50 | 49 | 47 | 54 | 43 | 49 | 51 | 54 | 43 | 45 | 48 |
| Bil-berry | 24 | 35 | 38 | 33 | 43 | 24 | 29 | 42 | 55 | 22 | 24 | 31 |
| Tea | −3 | 18 | 14 | 5 | 21 | −2 | 10 | 12 | 23 | −4 | 1 | 7 |
| Clay | 62 | 64 | 63 | 61 | 63 | 64 | 65 | 62 | 62 | 63 | 62 | 64 |

From Table 4, it can be seen clearly that the best product was that containing vinyl benzoate closely followed by that containing ethylidene benzoate acetate. The latter is currently preferred however on account of its attractive handling characteristics. Both products were markedly better than that containing TAED.

When similarly buffered compositions to BAT were made, but with the TAED adsorbed beforehand in the PBSI, similar washing performance to BAT was obtained, indicating that once again the absorption had not impaired the generation of active bleaching species in use.

Similarly, adsorption of activators capable of producing hydrophobic peroxyacid e.g. ethylidene heptanoate acetate and ethylidene 2-ethyl-hexanoate acetate, did not retard generation of peroxyacid in use compared with PBSI and the activator added separately. Such activators were made by acid catalysed reaction between vinyl acetate and the corresponding aliphatic acid.

Preparation of solid activator/PBSI compositions.

In this group of Examples and Comparisons, a standard solid N-acyl activator, TAED was adsorbed into PBSI, and their stability was compared with mixtures of the solid ingredient. In each Example product TAA and TAB, 1.316 g of TAED (95% purity) was dissolved in 6 ml of methylene dichloride and the solution shaken with 9 g PBSI (N grade commercially available from Peroxid-Chemie GmbH, Honningen, Germany). The solvent was allowed to evaporate off and the absorbed activator mixed with 19.5 g solids, consisting entirely of anhydrous sodium sulphate in TAA and a mixture of an acid buffer, 6 g benzoic acid and 13.5 anhydrous sodium sulphate in TAB.

In comparisons TMA and TMB, products containing similar weights of each solid ingredient to TAA and TAB were obtained by mixing the corresponding weight of dry solids together.

The various compositions were them stored, either in sealed dry bottles at 32° C. (condition D) or in open glass bottles at 28° C./70% relative humidity (condition H). The total avox of each sample was measured both at the start of storage and periodically by a standard iodometric method. The results are summarised in Table 5 below, expressed in the form of % of initial avox lost during storage.

TABLE 5

| | | % Avox lost after | | | |
|---|---|---|---|---|---|
| | | 4 weeks | | 8 weeks | |
| Ex/Comp | Product | D | H | D | H |
| 7 | TAA | 8 | 19 | 8 | 24 |
| 8 | TAB | 6 | 8 | 14 | 25 |
| Comp 7 | TMA | 10 | 26 | 17 | 32 |
| Comp 8 | TMB | 24 | 29 | 34 | 48 |

Surprisingly, it can be seen that the adsorbed activator compositions are more stable than the corresponding mixed solids activator/persalt compositions, irrespective of whether the storage conditions are dry or humid and of whether acid buffer is present.

Corresponding testing for activator stability showed a very similar ranking of the products.

Consequently the adsorbed activator compositions retained better their ability to generate peracids in use than did the simpler admixed compositions.

I claim:

1. A composition comprising particulate sodium perborate monohydrate having adsorbed therein one or more O-acyl or N-acyl bleach activators.

2. A composition according to claim 1 in which the activator is a liquid O-acyl or N-acyl activator.

3. A composition according to claim 1 in which the activator is an O-acyl compound in which the acyl group has the formula $R^a$—CO— in which $R^a$ represents hydrogen or an aliphatic $C_1$ to $C_9$ group or an aromatic group, optionally substituted by an alkyl or carboxylic acid group, or has the formula —CO—$R^b$—CO— in which $R^b$ represents an aliphatic $C_2$ to $C_{10}$ diradical or an aromatic or cyclohexenyl diradical, optionally substituted by one or more alkyl or carboxylic acid groups.

4. A composition according to claim 3 in which the activator is an enol ester or a gem diester which has the following general formula (I):

$$(E)_m—R^c—(G)n \quad (I)$$

in which E represents a moiety of formula (II)

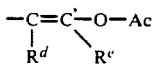

(II)

and G represents a moiety of formula (III)

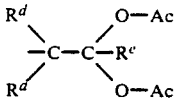

(III)

and m and n are 0, 1 or 2 provided that n+m=1 or 2, in which formulae $R^d$ is selected from hydrogen or $C_1$–$C_5$ alkyl or $C_2$–$C_4$ alkenyl or a phenyl radical, and $R^e$ is selected from hydrogen or $C_{1-5}$ alkyl radical or a phenyl radical, or combines with $R^c$ or $R^d$ and the olefin group in formula (II) to form a carbocylic radical, $R^c$ is selected from hydrogen or $C_1$–$C_5$ alkyl or $C_2$–$C_4$ alkenyl or phenyl radicals when n+m=1 and is selected from a carbon-carbon bond or represents a branched or unbranched aliphatic or cycloaliphatic or aromatic hydrocarbon diradical, when n+m=2 and Ac represents an acyl group which has the formula $R^a$—CO— in which $R^a$ represents a hydrogen group or an aliphatic $C_1$ to $C_9$ group or an aromatic group, optionally substituted by an alkyl or carboxylic acid group, or has the formula —CO—$R^b$—CO— in which $R^b$ represents an aliphatic $C_2$ to $C_{10}$ diradical or an aromatic or cyclohexenyl diradical, optionally substituted by one or more alkyl or carboxylic acid groups.

5. A composition according to claim 4 in which $R^a$ represents an alkyl $C_1$–$C_4$ group.

6. A composition according to claim 4 in which the enol ester is selected from vinyl, isopropenyl, isobutenyl, n-butenyl, and cyclohexenyl esters or diethenyl esters spaced by phenylene or $C_2$–$C_4$ polymethylene radicals.

7. A composition according to claim 4 in which the enol ester is selected from vinyl acetate, isopropenyl acetate, divinyl adipate, divinyl azelate, divinyl trimethyladipate, vinyl benzoate, isopropenyl benzoate, divinyl phthalate or cyclohexenyl acetate or 1,4-diacetoxybuta-1,3-diene and 1,5-diacetoxypenta-1,4-diene.

8. A composition according to claim 4 in which the gem diester is selected from ethylidene or isopropylidene diesters and tetraesters of $C_4$–$C_{10}$ unbranched polymethylene diradicals optionally methyl or ethyl substituted.

9. A composition according to claim 8 in which the gem diester is selected from ethylidene diacetate, ethylidene dibenzoate, 1,1,4,4-tetraacetoxybutane 1,1,5,5-tetraacetoxypentane, ethylidene benzoate acetate, isopropylidene benzoate acetate, bis (ethylidene benzoate) adipate, and bis (ethylidene acetate) adipate or azelate or trimethyladipate.

10. A composition according to claim 4 in which the activator contains both an enol ester and a gem diester group.

11. A composition according to claim 10 in which the activator is 1,1,4-triacetoxybut-3-ene, 1,1,5-triacetoxypent-4-ene, or vinyl (ethylidene acetate) adipate

12. A composition according to claim 5 in which the activator is selected from vinyl benzoate, ethylidene benzoate acetate, divinyl adipate or vinyl acetate.

13. A composition according to claim 4 in which the or one $R^a$ represents an alkyl or cycloalkyl $C_6$–$C_9$ group, substituted by 0,1, 2 or 3 methyl or ethyl groups.

14. A composition according to claim 13 in which the activator is selected from ethylidene acetate cyclohexane carboxylate or heptanoate or hexanoate or octanoate or 2-ethyl-hexanoate or 3,3,5-trimethyl-hexanoate.

15. A composition according to claim 2 in which the activator is an N-acyl caprolactam in which the acyl group has the formula $R^a$—CO— according to claim 3.

16. A composition according to claim 15 in which the activator is N-acetyl caprolactam.

17. A composition according to claim 1 in which the activator is a solid N-acyl or O-acyl activator.

18. A composition according to claim 17 in which the activator is an N-acyl alkylene amine or an N-acyl glycol uril in which the acyl group has the formula $R^a$—CO— in which $R^a$ represents hydrogen or an aliphatic $C_1$ to $C_9$ group or an aromatic group, optionally substituted by an alkyl or carboxylic acid group.

19. A composition according to claim 18 in which the activator is selected from tetraacetyl (ethylene or methylene) diamine or a tetraacetylglycol uril.

20. A composition according to claim 1 in which the weight ratio of persalt:activator is from 10:1 to 3:1.

21. A composition according to claim 1 in which the activator is introduced together with up to 20% by weight based on the activator of an alkyl ester of silicate or titanate.

22. A composition according to claim 1 in which the persalt/activator particles are coated with 1 to 35% by weight of a non-reacting coating agent.

23. A composition according to claim 1 in which the persalt/activator particles are blended with one or more diluents.

24. A composition according to claim 1 further comprising one or more particulate surfactants to a total weight of 5–95% of the composition and one or more particulate detergent builders to a total weight of 0–90% by weight of the composition.

25. A composition according to claim 1 containing up to the weight of persalt activator or acid buffer.

26. A composition according to claim 24 containing up to 5% by weight of a complexing phosphoric acid builder or salt thereof 27. A process for generating a peroxyacid species comprising the step of bringing into contact water and particulate sodium perborate monohydrate having adsorbed therein one or more O-acyl or N-acyl bleach activators.

28. A process according to claim 27 effected in the presence of one or more surfactants.

29. A process according to claim 27 effected in the presence of sufficient buffer to generate a pH of from 7.5 to 9.0.

30. A process according to claim 26 effected at ambient to 60° C.

31. A process for manufacturing a composition according to claim 1 in which particulate sodium perborate monohydrate is mixed with liquid or molten activator at a temperature of from ambient to 60° C. and above the melting point of the activator until the mixture is free flowing and the mixture is then cooled or permitted to cool to ambient.

32. A process for manufacturing a composition according to claim 1 in which the activator is dissolved in a solvent selected from hydrocarbons, chlorinated hydrocarbons, ethers and esters having a boiling point of up to 70° C., adsorbed onto a particulate sodium perborate monohydrate and the solvent evaporated off.

* * * * *